US007465869B1

(12) United States Patent
Freitas

(10) Patent No.: US 7,465,869 B1
(45) Date of Patent: Dec. 16, 2008

(54) MEMBRANES FOR USE WITH CAPACITIVE ELECTRIC VIBRATION TRANSDUCERS IN MUSICAL INSTRUMENTS

(76) Inventor: Paul John Freitas, 942 Pellegrini St., Santa Cruz, CA (US) 95062

( * ) Notice: Subject to any disclaimer, the term of this patent is extended or adjusted under 35 U.S.C. 154(b) by 222 days.

(21) Appl. No.: 11/358,977

(22) Filed: Feb. 21, 2006

Related U.S. Application Data

(63) Continuation of application No. 10/710,782, filed on Aug. 2, 2004, now abandoned.

(51) Int. Cl.
*G10H 3/00* (2006.01)

(52) U.S. Cl. ..... 84/723; 84/687

(58) Field of Classification Search ..... 84/723, 84/733, 687; 310/364
See application file for complete search history.

(56) References Cited

U.S. PATENT DOCUMENTS 729,936 A 6/1903 Heybeck
3,523,275 A * 8/1970 Gross ..... 367/107
4,213,368 A 7/1980 Cox
4,279,188 A * 7/1981 Scott ..... 84/723
4,852,443 A 8/1989 Duncan et al.
4,900,972 A * 2/1990 Wersing et al. ..... 310/364
4,947,725 A * 8/1990 Nomura ..... 84/723
5,105,710 A * 4/1992 Rothmel ..... 84/730
6,576,829 B1 * 6/2003 Hart ..... 84/737
6,586,666 B2 * 7/2003 Abe ..... 84/477 R

* cited by examiner

*Primary Examiner*—Walter Benson
*Assistant Examiner*—Jianchun Qin

(57) ABSTRACT

Membranes for use with capacitive electric musical instrument vibration transducers comprise an acoustically vibrating surface, a vibrating variable capacitor plate made from an electrically conductive material, and means of electrically connecting said vibrating variable capacitor plate to the electric circuitry of a capacitive electric musical instrument vibration transducer. These membranes can be used as drumheads, banjo membranes, and other stretched vibrating surfaces on similar musical instruments. In addition to generating the sound associated with these instruments, these membranes help capacitive electric musical instrument vibration transducers generate a signal describing the emitted sound of the musical instruments they are attached to.

8 Claims, 5 Drawing Sheets

5a

5b

5c

5d

MEMBRANES FOR USE WITH CAPACITIVE ELECTRIC VIBRATION TRANSDUCERS IN MUSICAL INSTRUMENTS

CROSS-REFERENCE TO RELATED APPLICATIONS

This is a continuation of U.S. patent application Ser. No. 10/710,782, filed Aug. 2, 2004, now abandoned.

BACKGROUND OF INVENTION

This invention relates generally to the field of musical instruments, more particularly to membranes adapted for use in the capacitive electric musical instrument vibration transducers. A membrane is a flexible, acoustically-emitting vibrating surface on an acoustic musical instrument like a drum, banjo, tambourine, or other such instrument. The acoustic properties of a membrane is defined in part by the amount of tension applied to the membrane at its perimeter by an external device. These membranes are often referred to generally as drumheads, but the more general term membrane will be used in this discussion. Membranes in common use at the time of this writing frequently comprise thin plastic sheets, made of materials such as nonconductive polyester, animal hides, or Kevlar, attached to metal rings (sometimes referred to as hoops) at their perimeters. These rings fit over the shell or body of their respective instruments, and tension is applied to the membrane by a metal rim fastened to the instrument shell or body with tension rods. By adjusting the tension in the tension rods, the acoustic properties of the instrument (such as the frequencies of vibration of a drum) can be changed. Other tensioning devices, such as a simple string or rope looping through holes in the membrane and attached to an instrument shell or another membrane, are used as well. Both drums and banjos use nearly identical arrangements for applying tension.

A novel capacitive electric vibration transducer has been described in a related application for creating microphone-like signals describing an acoustic musical instrument's sound. These transducers can provide cleaner signals with better acoustic isolation than microphones, magnetic pick-ups, or other types of transducers can provide. Drums, banjos, tambourines, and other similar instruments commonly use membranes as their acoustically-emitting vibrating surfaces, and are in many respects ideal candidates for the use of these capacitive electric transducers. Their membranes, however, must include a vibrating variable capacitor plate as part of their construction, as well as a method for providing electrical contact between the vibrating variable capacitor plate and the electrical circuit portion of the transducer.

As part of a pressure transducer triggering device for electronic drum systems, which generate signals through the use of a synthesizer or similar electronic device instead of using an acoustic instrument's vibrations directly, Duncan shows a drumhead-like device consisting of a layer of conductive rubber with an array of 3D projections placed underneath a protective cover layer. This device is not designed to be applied to a traditional acoustic drum or any other acoustic instrument, which requires the adjustable application of tension not present in Duncan's device. Furthermore, this device is not suitable for use with the vibration transducer referenced above because the rubber layer significantly dampens any vibrations in the cover layer (rubber is commonly used as an acoustic damping material). The array of projections in the rubber needed for Duncan's device dampen vibrations even further, making Duncan's device even more unsuitable for use in an acoustic musical instrument. These shortcomings for the present application are understandable because Duncan's invention is not intended to be an acoustic musical instrument either in whole or in part; it is merely a triggering device for synthesizers, drum modules, and the like.

Apart from the capacitive electric musical instrument vibration transducer mentioned above, modern drums and banjos may sometimes have other kinds of electronics placed inside their shell bodies. For example, microphones and triggering devices for synthesizers, drum modules, and other such devices can be incorporated into a traditional acoustic drum. These devices may be susceptible to electromagnetic interference from external electrical devices, such as a computer or a nearby radio transmitter tower, and may benefit from electromagnetic shielding on the instrument. Since membranes can constitute the majority of the surface area of an instrument body for an instrument like a drum or banjo, it can be useful to incorporate electromagnetic shielding into a musical membrane directly, including means of grounding the shielding electrically.

The primary object of this invention is to provide musical membranes (including drumheads and banjo membranes) specially adapted for use with the capacitive electric musical instrument vibration transducers referenced above. These drumheads will include an acoustically-emitting layer, a vibrating variable capacitor plate, and means of electrically connecting the plate to the electrical circuitry of the vibration transducer.

Another object of the invention is to provide musical membranes with integrated electromagnetic interference shielding for other applications. These membranes will include an electrically conducting portion of the membrane suitable for use as shielding, along with an electrical connection used for grounding the shielding electrically to the same potential as other shielding on the musical instrument.

A fuller understanding of the nature of the objects of the present invention will become apparent upon consideration of the following detailed description taken in connection with the accompanying drawings, wherein:

DETAILED DESCRIPTION

Figure 1:
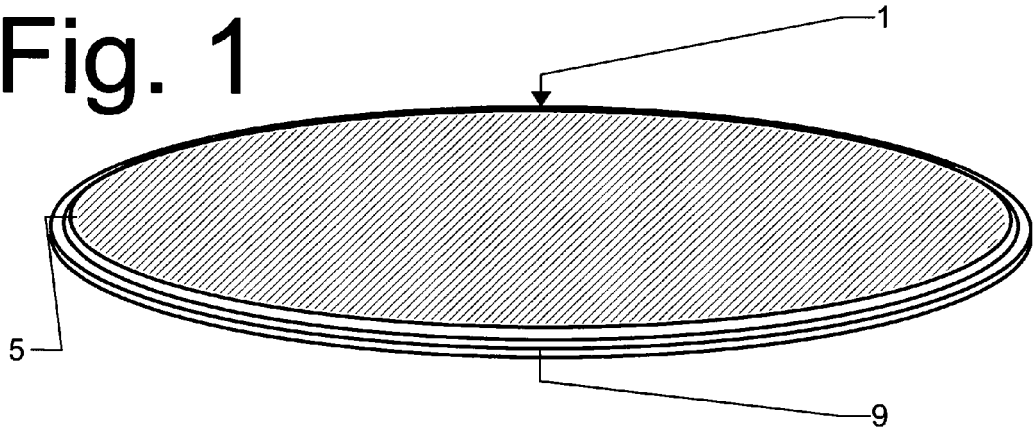
FIG. 1 gives a perspective view of an acoustic drumhead assembly, one embodiment of the invention.
Figure 2:
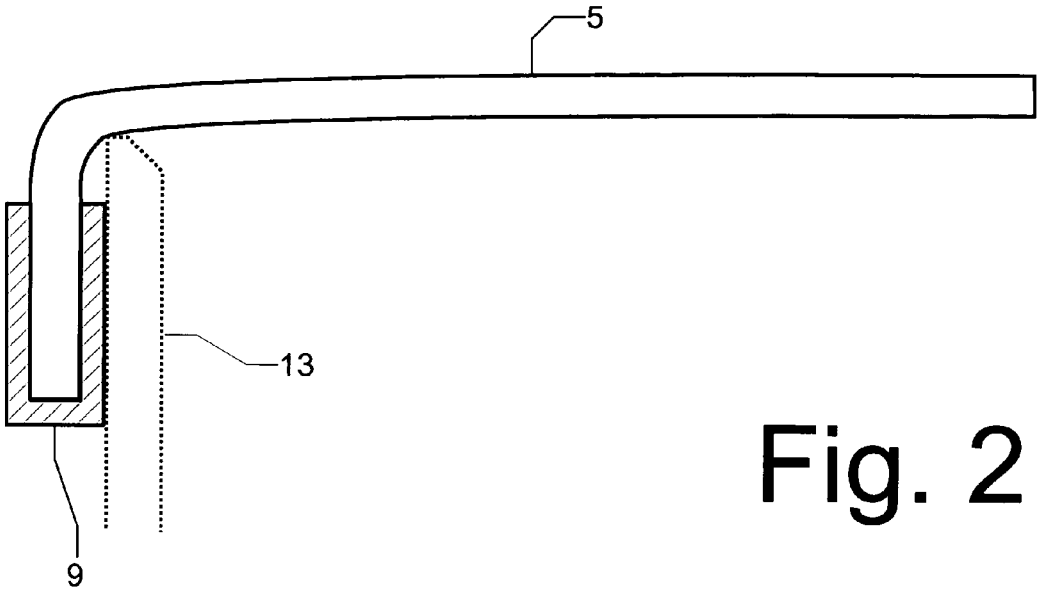
FIG. 2 shows an acoustic drumhead with a monolithic membrane in cross-section.

Referring now to the drawings, FIG. 1 depicts an acoustic drumhead assembly 1, one embodiment of the invention. It consists of a membrane 5 attached to a ring 9, and mounts on the end of a drum shell (not shown) using a conventional rim (not shown) and tension rods (not shown) as described earlier. Tension is applied to the tension rods to give the instrument the desired acoustic qualities during play. FIG. 2 shows the acoustic drumhead assembly 1 in cross-section. In this particular embodiment, the membrane 5 is of monolithic construction and features a single layer of electrically-conducting material. It can function as a vibrating variable capacitor plate by itself, as described below, as well as the acoustically vibrating surface found in all drumheads. The membrane 5 is mounted on a ring 9 made in this embodiment from a U-channel of metal (such as steel or aluminum) mechanically crimped onto the membrane 9 during manufacturing. Adhesives such as epoxy may also be used to attach the membrane 5 to the ring 9. A metallic ring 9 is not absolutely required. Wood, plastic, ceramics, or other sufficiently strong materials may be used instead.

The exact choice of material and its thickness depends on many factors, including the desired acoustic properties of the drumhead assembly 1, the expected tension applied to said drumhead assembly 1 by the player of the drum, the desired durability characteristics of the membrane 5 during instrument play, and electrical considerations. In its most basic and inexpensive form, the membrane may consist of a thin, single layer of a metallic material (including, but not limited to, metals such as aluminum, bronze, brass, or tin) formed into a cap of the desired diameter by a sheet metal press. (Drumheads frequently range from 8 to 22 inches diameter.) The thickness of the metal defines the sound of the instrument during play and is subject to many artistic considerations. For this example, the thickness in this embodiment is 0.001 inches, but may be thinner or thicker as the artist desires. As for choice of material, pure aluminum is a reasonable choice because of its high tensile strength, excellent conductivity, low weight and low cost. As shown in FIG. 2, the drumhead 1 is in physical contact with a drum shell 13 when mounted on a drum. In this embodiment, the drum shell 13 is assumed to be made of a pure metallic conductor like aluminum to facilitate the installation of a capacitive electric vibration transducer (not shown). Here the drum shell 13 is electrically grounded through the electric circuit board (not shown) of the transducer. The vibrating variable capacitor plate must be grounded, and is in direct physical contact with the drum shell 13. Provided both the membrane 5 and the drum shell 13 have clean mating surfaces (i.e. have been appropriately cleaned, polished, and kept away from air to prevent oxidation of the aluminum surfaces), the tension applied to the lugs will be sufficient to maintain electrical contact between the membrane 5 and the drum shell 13.

Although pure aluminum was chosen as the membrane material for this example, other electrical conductors can be used as well. Copper is a better conductor than aluminum, but is more susceptible to oxidation. To ensure better electrical connectivity with the drum shell 13, a small portion of the membrane 5 and the drum shell 13 can be coated with a thin coat (15-30 microns) of gold, tin, or another less oxidizing metal where the two surfaces actually meet. This coating may be applied by electroplating, metallization, or other such methods. Conducting plastics may be used as well for the membrane 5 provided they have an electrical conductivity comparable to metals. These plastics can help give the drumhead 1 a more traditional sound during play than metal membranes would. Again, such decisions are left to the artist playing the instrument; there is no "best" choice. Also, it should be noted that the ring 9 need not be manufactured separately from the membrane 5. For example, if the membrane 5 is made of a sheet metal like aluminum or steel, a machine press can fold the edge of the membrane 5 into a ring 9 suitable for many applications.

It has been common practice for many decades to incorporate one or more holes of various sizes into a drumhead. The most common example is a reinforced hole several inches in diameter cut into a bass drum resonant head, which provides access to the interior of the drum for the placement of microphones and muffling devices (like pillows, pads applied with adhesives, etc.). Holes can assist in air pressure equalization as well, or change the acoustic qualities of a drum when played, including reducing or even increasing the loudness of a drum, depending on the sizes and quantities of holes and their placement. It is possible to incorporate holes into the membranes described here without severely impacting the function of the vibrating variable capacitor plate or its ability to function as electromagnetic shielding. However, placing electrical conductors through these holes during instrument play can adversely affect the signal quality from a capacitive electric vibration transducer or undermine the effectiveness of an electromagnetic shield, so caution is advised for these reasons.

It should be noted that banjo membranes are constructed in much the same manner as drumheads, so this design can work for banjo membranes as well.

Figure 3:
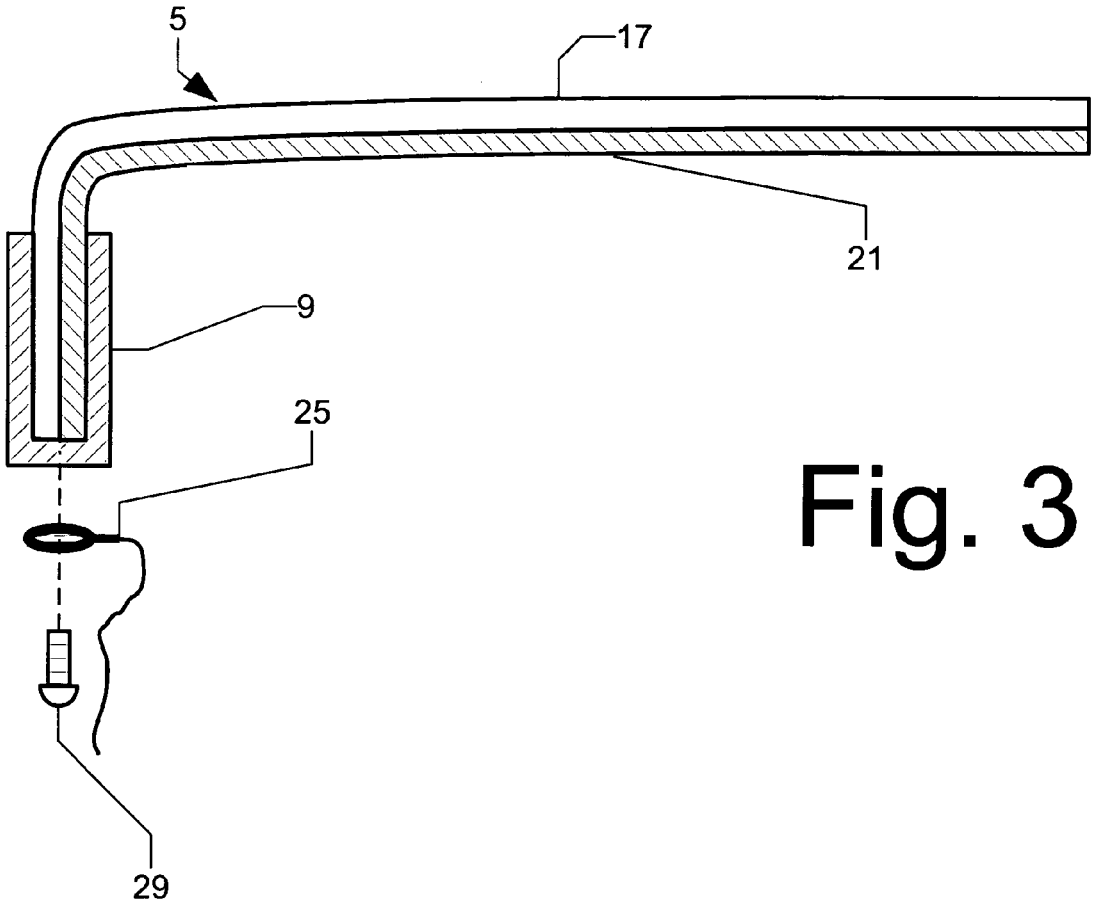
FIG. 3 shows an acoustic drumhead with a multilayer composite membrane in cross-section.

FIG. 3 shows a drumhead 1 where the membrane 5 is made of a multilayered material. This is useful when the acoustic properties of the drumhead 1 are best defined by one material but the electrical properties are better defined by another. In this embodiment, the acoustic vibrating surface 17 is a traditional polyester film several mils thick, depending on the sound desired by the user. The vibrating variable capacitor plate 21 in this embodiment is a layer of aluminum foil 1 mil thick attached to the acoustic surface 17 with an adhesive. The vibrating variable capacitor plate may take other forms, including (but not limited to) a layer of metal (like aluminum or copper) applied by metalization, or a layer of a conductive plastic. Using a conductive plastic layer would allow the whole membrane 5 to be constructed like an ordinary two-layer drumhead. In this embodiment, the ring 9 is again made of a U-channel of metal like aluminum or steel, and is also again crimped onto the membrane 5, thus establishing an electrical contact between the vibrating variable capacitor plate 21 and the ring 9. Instead of using friction and tension alone to establish electrical contact with the transducer, which is less reliable at low lug tension, this embodiment uses a wire with a ring connector 25 secured at the drumhead end to the ring 9 with a screw 21. The other end of the wire may attach to the shell or the electrical circuitry of the transducer, as required for the particular application.

As with the previous embodiment, it is possible to incorporate one or more holes of varying sizes into the membrane face for the reasons stated earlier. This design may also be used for banjo membranes, being the same basic construction as a drumhead.

Figure 4:
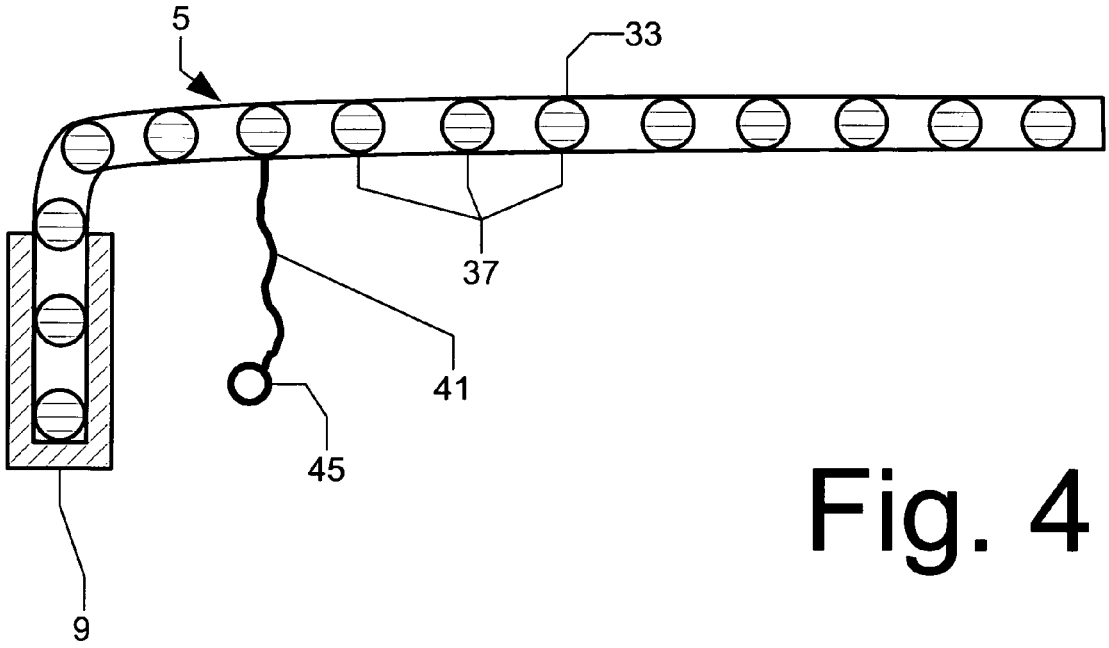
FIG. 4 shows an acoustic drumhead with a mesh membrane for said acoustic drumhead.

FIG. 4 again shows a cross-sectional view of a drumhead where the membrane 5 comprises a mesh 33 of metal (including but not limited to copper or steel) wires 37. These wires 37 may be woven together or arranged in layers and then soldered or welded together. Wire thickness can vary depending on the application, but 22 gauge is a common size. For best electrical contact, soldering or welding the interconnection points is highly recommended, whatever method is used to arrange them. In this embodiment, a connection wire 41 with a ring connector 45 is soldered to the mesh 33, which may then be attached to the instrument shell (not shown) or transducer circuitry (not shown) with a screw, terminal, or other connection device. Other types of connector may be used instead of the ring connector 41, depending on the electrical requirements. The spacing in the mesh can be varied depending on the desired acoustic and electrical characteristics; spacings of 0 to 0.5 inches are not difficult to imagine for a range of applications.

For reasons related to acoustics, electrical characteristics, durability, and other such factors, it may be desirable to coat the metal mesh 33 in a plastic such as PVC. (Making the mesh from a single strand of woven electrical wire is also possible, but is not recommended due to the high inductivity that can result.) Such a coating can be applied after weaving and soldering/welding using a dip or spray.

Figure 5:
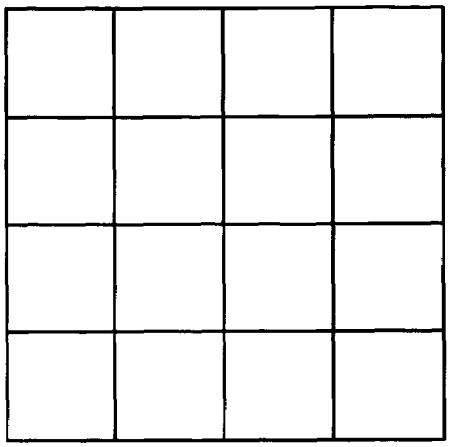
FIG. 5 shows a number of possible mesh weave patterns that can be used for a mesh membrane as shown in FIG. 4.
Figure 5:
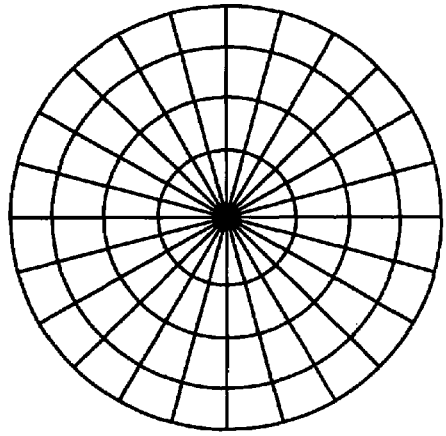
Figure 5:
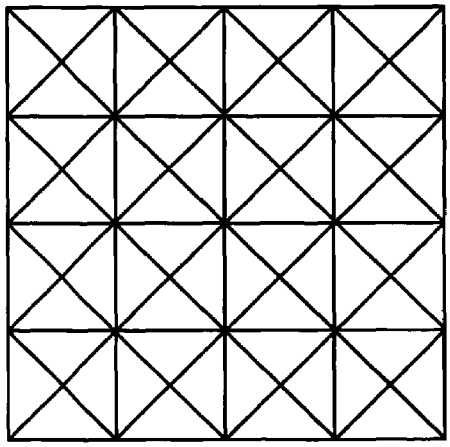
Figure 5:
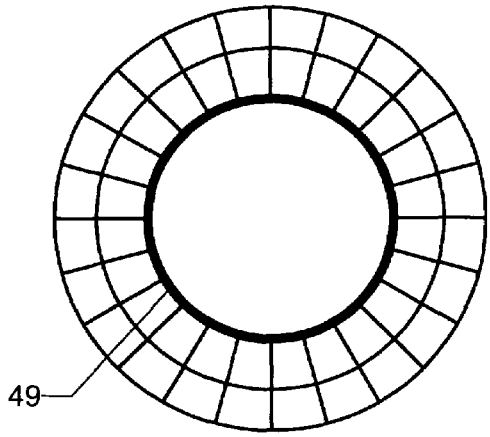

In FIG. 5 we see a number of possible mesh patterns that may be used for the mesh 33. FIG. 5*a* shows a square grid, which is widely available commercially on hardware cloth and screening materials. In FIG. 5*b* we see a circularly-symmetric pattern similar to a spider's web. Such a pattern may give better acoustic properties than a rectangular grid, and may therefore be more desirable acoustically. In FIG. 5*c* we see a square grid with a second grid intersecting it at an angle of 45 degrees. Lastly, in FIG. 5*d* we see another spider web-type arrangement, with a circular target 49 overlaying the center of the mesh. This target 49 can be made from a piece of polyester, cloth, rubber, or another desired material, and can be used to enhance the acoustic properties of the drumhead, provide an easier striking target with larger meshes, or allow for easier attachment of a bridge if the membrane is to be used on a banjo. The target 49 can be attached to the mesh 33 through a number of methods, including adhesives, cable ties, and other methods. The target 49 can be offset from the center of the drumhead as needed. A banjo membrane, for example, could benefit from having an offset target 49 to make bridge placement easier.

The invention claimed is:

1. An apparatus comprising a membrane for use in musical instruments comprising, in combination:

a. an acoustically vibrating layer comprising a two dimensional layer of flexible and precisely tensionable material specially formed to be stretched in a controlled manner across an appropriate aperture of a musical instrument and vibrating in response to the playing of said instrument;

b. an electrically conducting layer comprising a two dimensional, flexible, precisely tensionable, and electrically conductive material of approximately the same dimensions as said acoustically vibrating surface, where said electrically conducting layer is attached to said acoustically vibrating layer across its entire surface where the attachment is not external to said membrane such that said electrically conducting layer vibrates in unison with said acoustically vibrating layer during the playing of said musical instrument, and;

c. an electrical connection, comprising a permanently attached conductor with a suitable connector or a surface appropriately prepared to ensure good electrical connectivity through physical contact with an external conductor, to connect said electrically conducting layer, through a low impedance electrical conductor, to a source of electrical grounding;

wherein said membrane is a monolithic construction formed of a single piece of material comprising both said electrically conducting layer and said acoustically vibrating layer; and whereby said apparatus is used to simultaneously emit sound waves characteristic of the sound of said musical instrument during the playing of said instrument, function as a vibrating variable capacitor plate for a capacitive electric musical instrument vibration transducer, and form a portion of an electromagnetic interference shield for electronic devices contained inside said musical instrument.

2. Apparatus as described in claim 1, further comprising a rigid mounting ring placed on the perimeter of said membrane to aid in the placement and precision tensioning of said membrane on said musical instrument.

3. Apparatus as described in claim 2, where said mounting ring is formed of a rigid material formed separately from said membrane.

4. Apparatus as described in claim 2, where said mounting ring is formed by mechanically folding or rolling material located on the edge of said membrane to create the necessary rigidity in said mounting ring.

5. Apparatus as described in claim 1, further comprising a series of holes, gaps, or voids allowing air to pass freely through said membrane.

6. Apparatus as described in claim 5, where said membrane is formed of a metallic mesh.

7. Apparatus as described in claim 1, where said acoustically vibrating layer is formed of a single piece of plastic, and where said electrically conducting layer is formed by applying a layer of metal to one face of said acoustically vibrating layer with an adhesive compound.

8. Apparatus as described in claim 1, where said acoustically vibrating layer is formed of a single piece of plastic, and where said electrically conducting layer is formed by applying a layer of metal to one face of said acoustically vibrating layer by metalization of said face.

* * * * *